United States Patent [19]

Taniguchi et al.

[11] Patent Number: 4,796,049

[45] Date of Patent: Jan. 3, 1989

[54] HEAT ROLLER FOR ELECTROPHOTOGRAPHIC COPYING MACHINE

[75] Inventors: Hideaki Taniguchi, Nara; Koichi Moriyama; Osamu Kawasaki, both of Yamatokoriyama; Ken-ichi Iwamoto, Nara, all of Japan

[73] Assignee: Sharp Kabushiki Kaisha, Osaka, Japan

[21] Appl. No.: 171,168

[22] Filed: Mar. 21, 1988

Related U.S. Application Data

[63] Continuation of Ser. No. 928,369, Nov. 10, 1986, abandoned.

[30] Foreign Application Priority Data

Nov. 11, 1985 [JP] Japan ..... 60-253597

[51] Int. Cl.[4] ..... G03G 15/20; B21B 27/06

[52] U.S. Cl. ..... 355/3 FU; 219/216; 219/469

[58] Field of Search ..... 355/3 FU, 14 FU; 219/216, 469, 470; 29/121.8, 121.1

[56] References Cited

FOREIGN PATENT DOCUMENTS

| | | | |
|---|---|---|---|
| 109283 | 5/1984 | European Pat. Off. | 355/3 FU |
| 143232 | 6/1985 | European Pat. Off. | 355/3 FU |
| 156046 | 10/1985 | European Pat. Off. | 355/3 FU |
| 1956160 | 8/1970 | Fed. Rep. of Germany . | |
| 52269 | 3/1984 | Japan | 355/3 FU |
| 146278 | 8/1985 | Japan | 355/3 FU |
| 213974 | 10/1985 | Japan | 355/3 FU |

*Primary Examiner*—Arthur T. Grimley
*Assistant Examiner*—Ed Pipala
*Attorney, Agent, or Firm*—Birch, Stewart, Kolasch & Birch

[57] ABSTRACT

A surface of a heated fixing roller is coated with a tetrafluoroethylene resin in which pin holes are present in the range of about 5–30 unit/cm$^2$ and the diameter of the pin holes is in the range of about 5–20 $\mu$m.

1 Claim, 1 Drawing Sheet

HEAT ROLLER FOR ELECTROPHOTOGRAPHIC COPYING MACHINE

This application is a continuation of application Ser. No. 928,369 filed on Nov. 10, 1986 now abandoned.

BACKGROUND OF THE INVENTION

The present invention relates to an electrophotographic copying machine and, more particularly, to the structure of a heat roller in a heat fixing device in an electrophotographic copying machine.

In the surface of a conventional heating roller in a heat fixing device in an electrophotographic copying machine, a heat-resistive resin is coated thereon to improve easy release to toner particles from the surface of a heated fixing roller and a compression roller. However, the resin material to be coated on the rollers is dielectric so that the heated fixing roller itself is charged to absorb the tonner particles, resulting in an offset of the toner particles. The resin may become electrically conductive by the addition of conductive particles. However, such mixing of the conductive particles may damage the release property and mechanical strength.

SUMMARY OF THE INVENTION

Accordingly, it is an object of the present invention to provide an improved structure of a heated fixing roller for a fixing device in an electrophotographic copying machine for improving release characteristics of toner particles.

It is another object of the present invention to provide an improved surface structure of a heated fixing roller in a fixing device in an electrophotographic copying machine for ensuring easy release to toner particles from the heated fixing roller.

Briefly described, in accordance with the present invention, the surface of a heated fixing roller in a heated fixing device for an electrophotographic copying machine is coated with tetrafluoroethylene resin having a density of pin holes of about 5–30 unit/cm$^2$ and the diameter of each pin hole of about 5–20 $\mu$m.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
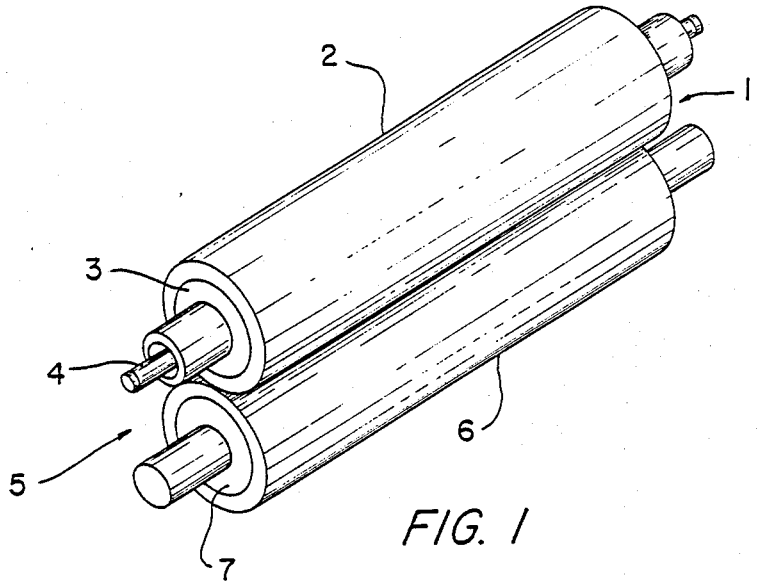
FIG. 1 is a perspective view of a heat fixing device for an electrophotographic copying machine according to the preferred embodiment of the present invention.

FIG. 1 is a perspective view of a heat fixing device of an electrophotographic copying machine according to the preferred embodiment of the present invention.

Figure 2:
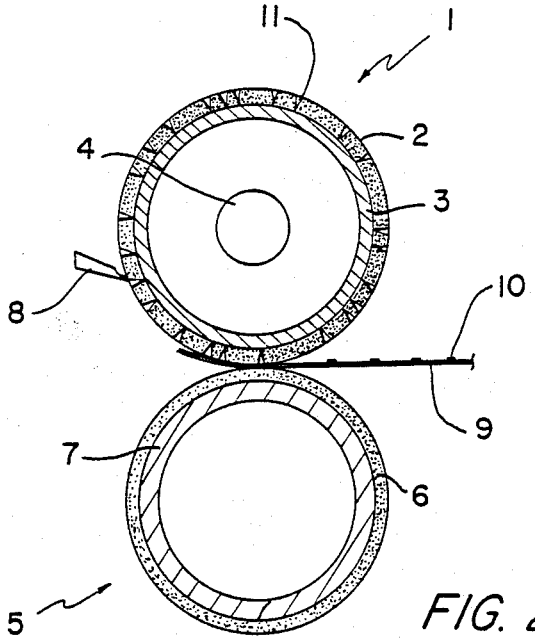
FIG. 2 is a cross-sectional view of a heated fixing roller and a compression roller in the heat fixing device of the present invention.

FIG. 2 is a cross-sectional view of the heated fixing roller and the compression roller.

A heat fixing roller 1 and a compression idle roller 5 are provided in combination for pressing a toner image onto a copied paper 9 bearing toner particles 10 transported as shown in FIG. 2. The heated fixing roller 1 includes a heater 4 at the inner side for heating the roller 1. An aluminum roll core 3 is provided. A coating 2 of tetrafluoroethylene resin is formed around the roll 3. The compression idle roller 5 comprises an aluminum roll core 7 and a silicone rubber coating 6. A paper separation claw 8 is positioned adjacent the heating fixing roller 1.

According to the feature of the present invention, the resin coating 2 has a plurality of pin holes 11. The density of the pin holes 11 is tested as follows.

Around the aluminum roll core 3 of about 40 mm in diameter, the tetrafluoroethylene resin is coated in the range of about 10–30 $\mu$m to prepare a heated fixing roller specimen. With the roller, the offset of the toner particles are tested.

| Pin Holes(unit/cm$^2$) | 40 | 20 | 7 | 4 | 2 | 0 |
|---|---|---|---|---|---|---|
| Test Result | Δ | O | O | Δ | x | x |
| Diameter of Pin Holes | | 30 | 20-5 | 5-1 | 0.4 | |
| | | x | O | Δ | x | |

Test Result Symbols

O: No Offset is generated.
Δ: Little offset is generated.
x: Offset is generated.

To measure the diameters of the pin holes, the pin hole testing is conducted as follows. Copper is deposited by being sintered into a solution of a 5% copper sulfate plus 1% NaCl. The sintered time is 180 minutes. The diameter of the pin holes is detected with reference to the deposited amount.

As tested above, to avoid the offsert and afford good copying, the porosity of the pin holes is preferable in the range of about 5–30 unit/cm$^2$ and the diameter of the pin holes is in the range of about 5–20 $\mu$m.

While only certain embodiments of the present invention have been described, it will be apparent to those skilled in the art that various changes and modifications may be made therein without departing from the spirit and scope of the present invention as claimed.

What is claimed is:

1. A heat fixing device for an electrophotographic copying machine comprising heat fixing roller means and compression roller means for fixing a toner image onto a copied paper in combination with said heat roller means, comprising:

a tetrafluoroethylene resin coating provided at the surface of said heat fixing roller means;

through pin holes said tetrafluoroethylene resin coating being present in the distribution of about 5–30 holes/cm$^2$ and the diameter of said pin holes being in the range of about 5–20 $\mu$m.

* * * * *